US010259251B2

(12) United States Patent
Forrest

(10) Patent No.: US 10,259,251 B2
(45) Date of Patent: Apr. 16, 2019

(54) SECURITY TOKEN AND AUTHENTICATION

(75) Inventor: Peter Alexander Forrest, Nedlands, WA (US)

(73) Assignee: OKT Limited, St. Helier (GB)

( * ) Notice: Subject to any disclaimer, the term of this patent is extended or adjusted under 35 U.S.C. 154(b) by 1567 days.

(21) Appl. No.: 13/978,624

(22) PCT Filed: Jan. 6, 2012

(86) PCT No.: PCT/EP2012/050191

§ 371 (c)(1),
(2), (4) Date: Sep. 30, 2013

(87) PCT Pub. No.: WO2012/095370

PCT Pub. Date: Jul. 19, 2012

(65) Prior Publication Data

US 2014/0015242 A1 Jan. 16, 2014

Related U.S. Application Data

(63) Continuation-in-part of application No. 12/930,517, filed on Jan. 10, 2011, now Pat. No. 8,705,805.

(30) Foreign Application Priority Data

May 10, 2011 (GB) ..... 1107723.7

(51) Int. Cl.

| | |
|---|---|
| ***B42D 15/00*** | (2006.01) |
| ***G07D 7/121*** | (2016.01) |
| ***G07D 7/2033*** | (2016.01) |

(52) U.S. Cl.

CPC ..... *B42D 15/00* (2013.01); *G07D 7/121* (2013.01); *G07D 7/2033* (2013.01); *Y10T 428/26* (2015.01)

(58) Field of Classification Search

CPC ..... B42D 15/00; G07D 7/2033; G07D 7/121; Y10T 428/26

(Continued)

(56) References Cited

U.S. PATENT DOCUMENTS

| | | | |
|---|---|---|---|
| 3,861,886 | A | 1/1975 | Meloy |
| 4,476,468 | A | 10/1984 | Goldman |

(Continued)

FOREIGN PATENT DOCUMENTS

| | | | |
|---|---|---|---|
| AT | 207138 | B | 1/1960 |
| AT | 264871 | B | 9/1968 |

(Continued)

OTHER PUBLICATIONS

Notice of Allowance for U.S. Appl. No. 12/930,517 dated Dec. 6, 2013.

(Continued)

*Primary Examiner* — Justin V Lewis
(74) *Attorney, Agent, or Firm* — Banner & Witcoff, Ltd.

(57) ABSTRACT

Security token (20) comprising: a substrate (21) and; an authentication element mounted to the substrate and formed from a solid material containing one or more minerals. Furthermore, a security token authenticator and method comprising: an optical detector arranged to generate a signal in response to an interaction of light with an authentication element within a security token, the authentication element formed from a solid material containing one or more minerals; and a processor configured to: compare the generated signal with a previously obtained signal from the authentication element; and provide an output based on the comparison.

4 Claims, 3 Drawing Sheets

(58) Field of Classification Search
USPC ..... 283/72, 85, 87, 90, 901
See application file for complete search history.

(56) References Cited

U.S. PATENT DOCUMENTS

| | | | | |
|---|---|---|---|---|
| 4,825,801 | A | 5/1989 | Weber | |
| 4,982,073 | A * | 1/1991 | Stenzel | G06K 19/10 283/904 |
| 5,521,984 | A | 5/1996 | Denenberg et al. | |
| 5,619,025 | A | 4/1997 | Hickman et al. | |
| 6,239,867 | B1 | 5/2001 | Aggarwal | |
| 6,261,469 | B1 | 7/2001 | Zakhidov et al. | |
| 6,396,941 | B1 | 5/2002 | Bacus et al. | |
| 6,570,648 | B1 | 5/2003 | Muller-Rees et al. | |
| 6,576,155 | B1 | 6/2003 | Barbera-Guillem | |
| 6,924,893 | B2 | 8/2005 | Oldenbourg et al. | |
| 7,030,981 | B2 | 4/2006 | Bishop et al. | |
| 7,353,994 | B2 | 4/2008 | Farrall et al. | |
| 7,415,136 | B2 | 8/2008 | Gallagher et al. | |
| 7,793,837 | B1 | 9/2010 | Faith et al. | |
| 7,812,935 | B2 | 10/2010 | Cowburn et al. | |
| 2001/0019037 | A1 | 9/2001 | Zakhidov et al. | |
| 2002/0034618 | A1 | 3/2002 | Moshrefzadeh et al. | |
| 2002/0051264 | A1 | 5/2002 | Shiozawa et al. | |
| 2004/0203170 | A1 | 10/2004 | Barbera-Guillem | |
| 2004/0262400 | A1 | 12/2004 | Chang et al. | |
| 2005/0277710 | A1 | 12/2005 | Joyce et al. | |
| 2007/0121181 | A1 | 5/2007 | Moon et al. | |
| 2009/0127845 | A1* | 5/2009 | Mallol | B42D 25/355 283/93 |
| 2009/0217813 | A1 | 9/2009 | Carberry et al. | |
| 2011/0043821 | A1* | 2/2011 | Stewart | G01B 11/0675 356/504 |

FOREIGN PATENT DOCUMENTS

| | | | | |
|---|---|---|---|---|
| CA | 2719793 | A1 | 10/2009 | |
| DE | 18909085 | | 8/1999 | |
| DE | 10007466 | A1 | 3/2002 | |
| DE | 10051062 | A1 | 4/2002 | |
| DE | 10236409 | A1 | 2/2004 | |
| DE | 10238506 | A1 | 3/2004 | |
| DE | 102004055291 | A1 | 7/2005 | |
| DE | 102005045642 | A1 | 3/2007 | |
| DE | 102007020982 | A1 | 10/2008 | |
| DE | 102005045642 | B4 | 3/2009 | |
| EP | 1003146 | A2 | 5/2000 | |
| EP | 1354304 | B1 | 7/2006 | |
| FR | 2442719 | A1 | 6/1980 | |
| FR | 2864557 | A1 | 7/2005 | |
| GB | 2218044 | A | 11/1989 | |
| GB | 2324065 | A | 10/1998 | |
| GB | 2374831 | A | 10/2002 | |
| JP | 2003073600 | A | 3/2003 | |
| WO | 8706383 | A1 | 10/1987 | |
| WO | 9112146 | A2 | 8/1991 | |
| WO | 2004011273 | A2 | 2/2004 | |
| WO | 2007031077 | A1 | 3/2007 | |
| WO | 2008119125 | A1 | 10/2008 | |
| WO | 2008153503 | A1 | 12/2008 | |
| WO | WO-2009133390 | A1 * | 11/2009 | G01B 11/0675 |
| WO | 2010040180 | A1 | 4/2010 | |

OTHER PUBLICATIONS

Jul. 23, 2013 Final Office Action issued in U.S. Appl. No. 12/930,517.
International Search Report dated Apr. 17, 2012 (PCT/EP2012/050191); ISA/EP.
GB1107723.7 Search Report dated Mar. 30, 2012.
NL2008084 Search Report dated Apr. 3, 2012.
Oct. 28, 2016—(FR) Search Report—App 1200073.
"Microscopy Primer," Microscopy Resource Center; 2012 Olympus America Inc., http://www.olympusmicro.com/primer.
"Polarized Light Microscopy;" Nikon Microscopy U—The Source for Microscopy Education—https://www.microscopyu.com/articles/polarized/index.html.

* cited by examiner

SECURITY TOKEN AND AUTHENTICATION

FIELD OF THE INVENTION

The present invention relates to a security token, a security token authenticator and a method for authenticating a security token. Systems and methods are described for identifying and authenticating portable tokens, typically used to control access, by a person, to an entity, a benefit or a process. Another area of use is in the association of a token with one or more entities as an indicator of valid registration or allowance.

BACKGROUND OF THE INVENTION

Identifying and authenticating tangible articles, particularly high-value items, as being genuine is an important function. The art of photography and, more recently, electro-optical image recording, has enabled comparisons between an original and a suspect object, as exemplified in U.S. Pat. No. 5,521,984, where a reflected light microscope is used to make an image of very fine detail of subjects such as paintings, sculptures, stamps, gemstones, or of an important document. Forgery of an original work, or of an anti-counterfeiting device that is associated with goods of generally similar appearance, is one driving force for the art of authentication systems.

Though biometric and fingerprint identification systems may supersede many token-based access-control systems, an agreement without a document or a physical device has little weight in law: documents and devices are likely to persist as bonds of valid registration, allowance or entitlement, for example.

Rates of 'false-accepts' and 'false-rejects' are important for the utility of an authentication system, and closely related to the value of the entity or situation being controlled or to the security level required. A high 'false-reject' rate will lose consumer-confidence in the system, affecting both parties. A high-security facility or a passport-control may generally tolerate higher 'false-rejects' to the inconvenience of some person, with no 'false-accepts.' Similarly, for very high value items both rates should be close to zero. The examination and comparison processes can be precise and accurate, as exemplified in the U.S. Pat. No. 5,521,984 previously referred to, leaving overall security weakness in identification in the domain of the data-handling and storing processes employed.

The field of anti-counterfeiting devices for mid-price consumer goods and credit-cards has led to many inventions for two-dimensional devices for that market, including stamped transmission holograms and various improved diffractive optical devices. The utility of reflection holograms has some difficulties in cost and suitable materials: all holograms have limitations in scaling the subject matter. Some of these devices may be optically duplicated, however, and most have master dies that could be duplicated or misappropriated. In many cases these devices are read, the data is 'digested' and then compared to accompanying data. Abrasion-wear or flexing damage can cause problems with reading the authentic device and lead to higher 'false-rejects.' False-rejects' often require intervention by a human-being.

Some methods for device and document authentication use reflected coherent light as a method of obtaining a characteristic signature of the subject, as exemplified in U.S. Pat. No. 7,812,935. Generally, methods using speckle, complex diffractions or refraction have to contend with minor changes, unconnected with any fraud, causing large alterations in presented properties when read. The minor changes could occur at all points in the subject, e.g. thermal expansion, stress-fracturing, scratches or colour-fading; this creates difficulties in establishing identity without using multiple application of statistical percentiles to develop pass criteria, or may require data-digests to be made from encoding schemes held within the reading device.

The use of a third dimension, usually depth, in a security device is exemplified in U.S. Pat. No. 4,825,801, where glitter and dye-balls in a hardened resin, as a seal, practically defies successful duplication. This latter example's high-security application permits adequate time for the examination process. Subsequently, various multiple objects have been set in 'hardenable' liquids: by example, U.S. Pat. No. 7,353,994. Qualitatively these seem to be strong devices; quantifying the spatial features in them however, in a reading device, can be problematic.

Creating unique arrangements in a relatively thin security device is described in U.S. Pat. No. 7,793,837, wherein a captive brittle later in a consumer-card, such as a credit card, is intentionally shattered and the pattern of shards examined for authenticity.

In summary, these techniques have drawbacks including: physical changes to the token resulting in authentication failure; difficulties with reliability and implementing automated reading; and high costs.

Therefore, there is required a method and apparatus that overcomes these problems.

SUMMARY OF THE INVENTION

Against this background and in accordance with a first aspect there is provided a security token comprising:

a substrate and;

an authentication element mounted to the substrate and formed from a solid material containing one or more minerals. The security token may be used to authenticate an article such as an artwork, access card, consumer product, bank note, share certificate or other items, for example. The use of minerals makes it difficult or practically impossible to copy the security token, enables convenient authentication or checking based on optical or visual inspection and provides resistance to wear and tear. Therefore, use of a solid material containing or formed from one or more minerals as an authenticator, authentication element or security token, tag or label is provided.

Preferably, the authentication element may be at least partially transparent to ultraviolet, visible and/or infrared light. This may be due to material properties, the thickness of the authentication element or a combination of both.

Optionally, the authentication element may be mounted to the substrate by an adhesive. Other fixing means may be used.

Preferably, the adhesive may be an optical adhesive.

Optionally, the security token may further comprise an optical window at least partially covering the authentication element. This may further protect the authentication element and allow optical or visual access.

Preferably, the authentication element may be planar. This may be of a thin planar shape.

Preferably, the authentication element may be formed from rock. Rock or naturally occurring solid aggregate of minerals, has a benefit of being easily available and each sliver, section or sample is unique. Rock is hard wearing and robust. Rock may be easily worked. Rock usually contains several different minerals and there may be minerals within minerals providing a highly complex, stable, unique and difficult to reproduce structure that may be authenticated using its optical or other characteristics.

Preferably, the rock may be selected from the group of crustal rocks consisting of: igneous; sedimentary; and metamorphic. Other types may be used including synthetic rocks.

Advantageously, the authentication element may have unique optical properties.

Preferably, the authentication element may have a thickness of 300 micrometers or below. This provides enough material for authentication to take place and still allows light to pass through and be sampled by an authenticator. In particular, the thickness may be 250 micrometers or below.

Preferably, the authentication element may have a length and width in the range 0.5 mm to 60 mm. Other shapes and sizes may be used including 1 mm to 5 mm, in particular.

According to a second aspect there is provided an item secured by the security token as described above.

According to a third aspect there is provided a security token authenticator comprising:

an optical detector arranged to generate a signal in response to an interaction of light with an authentication element within a security token, the authentication element formed from a solid material containing one or more minerals; and a processor configured to:

compare the generated signal with a previously obtained signal from the authentication element; and provide an output based on the comparison. The security token authenticator may be used to interrogate and authenticate one or more security tokens of any of those described above or any other security token having the described authentication element. The signal generated by the optical detector may be an electronic signal or optical signal. The signal may contain information describing the structure of the authentication element, such as its composition, alignment and appearance (in 2D and/or 3D), for example. The interaction of light with the authentication element may include scattering, transmission and/or reflection, absorption, polarisation and fluorescence for example. The processor may be a CPU, computer, ASIC, FPGA, embedded system, local or remote, for example. The previously obtained signal may be locally stored, remotely stored or received when required, for example. The comparison may require a full match, partial match to a predetermined level or may involve an indirect match such as a comparison of an electronic fingerprint or numerical representation of the compared signals. For example, a sample of the generated signal may be converted to a value. This value may be compared to a converted value of the previously obtained signal, perhaps obtained when the authentication element was manufactured or validated. If the generated signal matches the previously obtained signal then the security token may be authenticated. The output may be in a binary form (e.g. pass/fail) or may provide a non-binary output such as a percentage of a confidence value. Such percentage or value may further have a threshold applied. For example, for a value over 90% the security token may be deemed to be genuine and authentic.

Optionally, comparing the generated signal with a previously obtained signal may comprise:

determining an optical property of the authentication element from the generated signal;

comparing the determined optical property to an optical property derived from the previously obtained signal of the authentication element. Again, the optical properties may be converted to values before comparison of those values. A match of values or a near match (within defined tolerances or limits) may then be determined.

Preferably, the security token authenticator may further comprise a light source arranged to illuminate the authentication element. This light source may be monochromatic (e.g. LED or laser) or polychromatic.

Advantageously, the security token authenticator may further comprise one or more linear polarisers arranged to vary the polarisation of light interacting with the authentication element and/or light collected by the optical detector. Therefore, the optical signal may be obtained under different polarisation orientations. The linear polarisers may be placed between a light source and the authentication element and/or between the authentication element and the optical detector or sensor.

Preferably, the one or more linear polarisers may be rotatable. This may be achieved electrically. Alternatively, the axis of polarisation may be achieved electronically or using electrostatics.

Optionally, the optical detector may further comprise a microscope. There may be an objective lens used to collect and/or illuminate the authentication element.

Preferably, the optical detector may further comprise a camera and the signal is an image or set of images obtained under different illumination or polarisation conditions. The camera may include a CCD or CMOS detector, for example.

Optionally, the determined and expected optical properties may be selected from the group consisting of: polarisation; image structure; refractive index; colour; luminance variations; optical absorption; and opacity. Other optical properties may be used.

Preferably, the security token authenticator may further comprise an electronic storage arranged to store the expected optical properties of a plurality of authentication elements. Values may be stored to represent the optical properties. The electronic storage may also store the generated optical signals. Physical storage, including photographs and film negatives, may also be used and compared.

Preferably, the security token authenticator may further comprise a mechanical alignment mechanism arranged to align the authentication element with the optical detector. This may be a physical socket that only admits the security token in its correct orientation, for example.

According to a fourth aspect there an authentication method comprising the steps of:

detecting a signal caused by the interaction of light with an authentication element within a security token, the authentication element formed from a solid material containing one or more minerals;

comparing the detected signal with a previously obtained signal from the authentication element; and providing an output based on the comparison. The output may be positive (indicating authentication) if the detected signal matches the previously obtained signal. The comparison or match maybe determined based on a range, value or percentage, for example.

Preferably, the method may further comprise the step of illuminating the authentication element.

Advantageously, the comparing step may further comprise the steps of:

determining an optical property of the authentication element from the generated signal;

comparing the determined optical property to an optical property derived from the previously obtained signal of the authentication element.

Preferably, the method may further comprise the steps of:

detecting a further signal caused by the interaction of light with the authentication element;

comparing the further detected signal with a further previously obtained signal from the authentication element; and providing a further output if the detected signal matches the further previously obtained signal.

Optionally, the method may further comprise the step of varying illumination of the authentication element. The further signal may be detected under different illumination conditions such as wavelength, polarisation, intensity, etc.

Optionally, varying the illumination varies any one or more of: polarisation; axis of polarisation; intensity; and wavelength.

Optionally, the method may further comprise the step of varying optical properties of a detector used to detect the interaction of light with the authentication element. Filters or polarisers may be introduced into, before or within a light path of the detector.

Optionally, varying the optical properties of the detector may comprise applying a polarisation shift.

Optionally, the method may further comprise the step of providing an authentication if the output and the further output both indicate matches.

The method described above may be implemented as a computer program comprising program instructions to operate a computer. The computer program may be stored on a computer-readable medium or sent as a signal.

The following numbered clauses illustrate further aspects of the invention. Any particular feature of these clauses may be used with any other feature or incorporated into any of the previously described aspects.

1. A system of identification and authentication of portable tokens comprising:
   (a) an essentially transparent portable token including a planar rock section of naturally-occurring rock of the Earth's crust of less than 250 micrometers in its least dimension, being in part or in whole transmissive of light rays in its least dimension;
   (b) a polychromatic, or monochromatic, linear-polarized light source;
   (c) a means of generating an image from that light, emanating from the linear-polarized light source, which may be transmitted by the planar rock section;
   (d) a means of recording images, being either a photographic plate or an electronic image-recorder.
   (e) one or more storage repositories of the data of the recorded images;
   (f) a comparison process, that may use a computer processor and memory, for comparing those recorded image data of a portable token, and planar rock section therein, that were recorded at different times;
   (g) a decision-process consequent to the comparison process that decides upon the authenticity of the portable token;
   (h) a binary indication of the decision of the preceding decision-process.
2. The system of clause 1 wherein further linear-polarizers, wave-retarding plates or wave-compensator plates are included in the optical light transmission path between said linear-polarized light source and said means of recording images.
3. The system of clause 1 wherein any storage repository of data contains a set of recorded images pertaining to a particular portable token, of which each member corresponds to a particular angular value between the polarization-axis of the linear-polarized light source and a predetermined axis that is orthogonal to the least dimension of the planar rock section.
4. The system of clause 1 which further includes an imaging-control subsystem including a computer processor and memory, that receives commands from the comparison process and transmits commands to said means of generating an image or said polychromatic or monochromatic linear-polarized light source with purposes that include:
   (a) translating the planar rock section relative to said means of generating an image or said polychromatic, or monochromatic, linear polarised light source, by any means;
   (b) varying the angular value between the polarization-axis of said linear-polarized light source and a predetermined axis that is orthogonal to the least dimension of the planar rock section, by any means.
5. The system of clause 1 which further includes any image-analysis subsystem including a computer processor and memory, for measuring and analyzing recorded image data and deriving one or more sets of data of attributes of a planar rock section, said data being used for a comparison process between said attributes of a planar rock section that were recorded, measured or derived at different times.
6. The system of clause 5 wherein the measurements and attributes that are stored in the memory of the image-analysis subsystem include any of the set of items comprising:
   (a) sets of coordinates in a colour-space coordinate system that represent changes in exhibited pleochroism in any mineral grain, between recorded images;
   (b) sets of coordinates in a colour-space coordinate system that represent changes in chromaticity in any mineral grain, between recorded images;
   (c) sets of coordinates in a scale of luminance or a scale of relative luminance that represent changes in luminance in any mineral grain, between recorded images;
   (d) sets of coordinates in a colour-space coordinate system which incorporates luminance that represent changes in chromaticity or luminance in any mineral grain, between recorded images;
   (e) numerical vectors representing paths of fractures or of mineral-grain boundaries;
   (f) values of refractive indices of any material comprising the portable-token;
   (g) values of birefringence of any mineral grains;
   (h) numerical vectors representing optical axes of any mineral grains.
7. A method of identifying and authenticating portable tokens, the method comprising the steps of:
   (a) directing light from a polychromatic, or monochromatic, linear-polarized light source toward an essentially transparent portable token including a planar rock section of naturally-occurring rock of the Earth's crust of less than 250 micrometers in its least dimension and being in part or in whole transmissive of light rays in its least dimension;
   (b) using a means of generating an image to form an image from that light which may be transmitted by the planar rock section through its least dimension;

(c) using a means of recording images, being either a photographic plate or an electronic image-recorder, to capture the light rays of the image and to record an image;

(d) storing the image data into one or more storage repositories for recorded reference images, as a reference to which later images recorded by the method may be compared;

(e) allowing the passage of any amount of time, during which time the portable token may, or may not, be removed from the means of generating an image apparatus;

(f) the repeating steps (a), (b) and (c), wherein the essentially transparent portable token is now subject to inquiry, due to the passage of time;

(g) storing the image data into one or more storage repositories of data of recorded images, as image data to be subjected to inquiry by a comparison process;

(h) comparing those recorded image data of the planar rock section that were recorded as a reference with those that were recorded for inquiry, by a comparison process, wherein the comparison process may use a computer-processor and memory;

(i) deciding upon the identity and authenticity of the portable token based upon a matching correspondence, or lack thereof, between the reference image data and the image data of the subject of inquiry;

(j) indicating, as a binary logic output, the decision as to whether or not the planar rock section in the portable token is authentic.

8. The method according to clause 7 with the additional step of interposing a linear-polarizer plate between the essentially transparent portable token and the means of recording images, such that those light rays emanating from the linear-polarized light source which may be transmitted by the planar rock section pass through the added linear-polarizer plate and into the means of generating an image.

9. The method according to clause 7 with the additional steps of:

(a) interposing a linear-polarizer plate between the essentially transparent portable token and the means of recording images, such that those light rays emanating from the linear-polarized light source which may be transmitted by the planar rock section pass through the added linear-polarizer plate and into the means of generating an image;

(b) positioning the added linear-polarizer plate such that its polarization axis is normal to the polarization axis of the linear-polarized light source;

(c) generating and recording a set of images pertaining to a particular portable token, of which each member corresponds to a particular angular value between the polarization-axis of the linear-polarized light source and a predetermined axis that is orthogonal to the least dimension of the planar rock section, to serve as reference images or subject-inquiry images.

10. The method according to clause 7 with the additional steps of:

(a) interposing a wave-retarding plate and a linear-polarizer plate between the essentially transparent portable token and the means of recording images, such that those light rays emanating from the linear-polarized light source which may be transmitted by the planar rock section pass through the added wave-retarding plate and the added linear-polarizer plate and, thereafter, into the means of generating an image;

(b) positioning the added linear-polarizer plate such that its polarization axis is normal to the polarization axis of the linear-polarized light source;

(c) generating and recording a set of images pertaining to a particular portable token, of which each member corresponds to a particular angular value between the polarization-axis of the linear-polarized light source and a predetermined axis that is orthogonal to the least dimension of the planar rock section, to serve as reference images or subject-inquiry images.

11. The method according to clause 7 with the additional steps of:

(a) selecting a position in any particular mineral grain that exhibits a variation in luminance between images recorded with different angular values between the polarization-axis of the linear-polarized light source and a predetermined axis that is orthogonal to the least dimension of the planar rock section;

(b) matching the luminance of that mineral-grain position to a scale of luminance values or relative luminance values;

(c) noting the matching coordinates on the scale of luminance values or relative luminance values and recording said same;

(d) matching the chromaticity of that mineral-grain position to a chromaticity coordinate system map;

(e) noting the matching coordinates on the chromaticity coordinate system map and recording said same;

(f) matching the chromaticity and luminance of that mineral-grain position to a colour-space coordinate system which represents chromaticity and luminance;

(g) noting the matching coordinates on the colour-space coordinate system map and recording said same;

(h) noting the angular value between the polarization-axis of the linear-polarized light source and a predetermined axis that is orthogonal to the least dimension of the planar rock section;

(i) repeating steps (a), (b), (c), (d), (e), (f), (g) and (h), in respect of the same particular mineral grain, for one or more images recorded with different angular values between the polarization-axis of the linear-polarized light source and a predetermined axis that is orthogonal to the least dimension of the planar rock section;

(j) combining the recorded coordinates from the scale of luminance values, or relative luminance values, with their corresponding recorded angular values to form a set of tuples that may represent a vector path in the coordinate space of the scale of luminance values used;

(k) combining the recorded coordinates from the chromaticity coordinate system with their corresponding recorded angular values to form a set of tuples that may represent a vector path in the coordinate space of the chromaticity coordinate system;

(l) combining the recorded coordinates from the colour-space coordinate system with their corresponding recorded angular values to form a set of tuples that may represent a vector path in the coordinate system of the colour-space;

(m) comparing the vector path data of those particular mineral-grain positions that are subject to inquiry with the corresponding vector data that was derived, by the same method, from recorded images of the planar rock section that were recorded as a reference;

(n) deciding upon the authenticity of the portable token based upon a matching correspondence or correlation, or lack thereof, between the set of reference image vector data and the set of vector data derived from the image data of the subject of inquiry;

(o) indicating, as binary logic output, the decision as to whether or not the planar rock section in the portable token is authentic.

12. The method of clause 7 wherein the binary logic output of step (j) is included in a set of data that either allows or disallows access to an entity, to a benefit or to a process, by the bearer of the portable token.

13. The method of clause 7 wherein the binary logic output of step (j) is included in a set of data that either validates or invalidates an entitlement of the bearer of the portable token.

14. One or more computer-readable media that are encoded with, or store, sets of instructions for a computer processor that when executed perform the method as recited in clause 7.

15. One or more computer-readable media that are encoded with, or store, sets of instructions for a computer processor that when executed perform the method as recited in clause 11.

16. A portable token device that is suitable for use in a portable-token identification and authentication system, as the item subject to inquiry, such as the system of claim 1, comprising:

(a) a planar substrate layer composed of any transparent crystalline ceramic material or partly-crystalline glass-ceramic material;

(b) a planar covering-plate layer composed of any transparent crystalline ceramic material or partly-crystalline glass-ceramic material;

(c) a planar section of naturally-occurring rock of the Earth's crust, of less than 250 micrometers in its least dimension, being in part or in whole transmissive of light rays in its least dimension and being interposed between the aforesaid planar substrate layer of item (a) and the aforesaid planar covering-plate layer of item (b);

(d) an adhesive cement that is essentially transparent to light rays, being interposed between the aforesaid planar substrate layer of item (a) and the aforesaid planar covering-plate layer of item (b).

17. The portable token device as defined in clause 16 which further includes one or more polarizing or wave-retarding plates interposed between said planar substrate layer and said planar covering-plate layer.

18. The portable token device as defined in clause 16 which, further, is marked externally or marked internally with a mark, an indicium, a sign, a symbol, a character, a graphical device, a graphical composition, an image, an emblem or a pattern of marks.

19. A portable token, comprising:

(a) a planar substrate layer composed of any transparent crystalline ceramic material or partly-crystalline glass-ceramic material;

(b) a planar covering-plate layer composed of any transparent crystalline ceramic material or partly-crystalline glass-ceramic material;

(c) a planar section of naturally-occurring rock of the Earth's crust, of less than 250 micrometers in its least dimension, being in part or in whole transmissive of light rays in its least dimension and being interposed between the aforesaid planar substrate layer of item (a) and the aforesaid planar covering-plate layer of item (b);

(d) an adhesive cement that is essentially transparent to light rays, being interposed between the aforesaid planar substrate layer of item (a) and the aforesaid planar covering-plate layer of item (b).

20. The portable token as defined in clause 19 which, further, is marked externally or marked internally with a mark, an indicium, a sign, a symbol, a character, a graphical device, a graphical composition, an image, an emblem or a pattern of marks.

It should be noted that any feature described above may be used with any particular aspect or embodiment of the invention.

BRIEF DESCRIPTION OF THE FIGURES

The present invention may be put into practice in a number of ways and embodiments will now be described by way of example only and with reference to the accompanying drawings, in which.

It should be noted that the figures are illustrated for simplicity and are not necessarily drawn to scale.

DETAILED DESCRIPTION OF THE PREFERRED EMBODIMENTS

The technical fields of transmitted-light optics, data-storage and handling, petrology, polarizing microscopes and crystallography are relevant to the following described examples.

Figure 1:
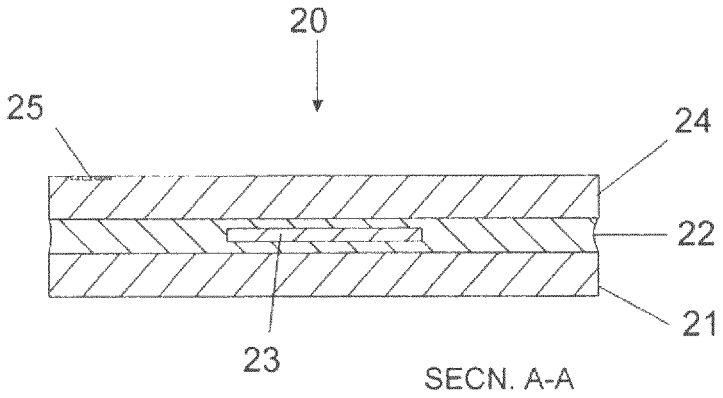
FIG. 1 depicts a cross-sectional schematic view of a portable or security token, given by way of example only. The cross-section is taken through the assembly shown in FIG. 2.

A portable token and systems and methods for identification and authentication of the same are disclosed. With reference to FIG. 1, the portable token, 20, may be utilized for a variety of purposes and uses a thin section of rock, 23, as a unique identifying element, which is highly resistant to forgery or duplication. Identification and authorisation of tokens may be achieved by a system that uses optical examination of the microstructure and the refractive and absorptive properties of crystalline minerals within the identifying element, especially by transmitted polarized light techniques. Comparison between stored reference data and acquired examination data may be the basis for verifying authenticity. The naturally-occurring three-dimensional orientations of the optical axes of mineral crystals contribute to the identification information by their effects. Uses include controlling access, by a person, to an entity, a benefit or a process.

According to one example implementation, a thin planar section of naturally-occurring rock of the Earth's crust may be used as an authentication element subject to identification, being contained within an essentially transparent and portable token. The planar rock section is preferably sufficiently thin to transmit light through the majority of the rock-forming minerals within. Image-forming optics may be used with transmitted polarized light to form and record luminance, colour and/or chromaticity image-data of the detailed assemblage of rock-forming minerals presented. These image data may then used as a basis for identifying and authenticating the token. Additionally, the invention may use naturally-occurring three-dimensional orientations of the optical axes of mineral crystals, principally by their effects, to obtain further defining information for use in identifying and authenticating the token: anisotropy of absorption spectra or refractive index in certain mineral crystals may be utilised.

The security token and authenticator may provide a portable-token identification and authentication system, which is more reliable and more often correct at determining identity and authenticity of the portable token than prior art systems and methods.

The system and method may also provide a portable token that, once fabricated, resists duplication, including by the original manufacturer, or by using his data, equipment, materials or knowledge: forgery of any of these portable tokens that the systems and methods could determine as being authentic may be considered to be very difficult by any practical means.

The system and method may also provide a portable token with a security element that is resistant to colour-fading, heat, cold, abrasion, shock and other physical effects that it may encounter in normal handling. The system and method may also be more able to disclose interference with the token than prior systems and methods: forgery attempts principally.

FIG. 1 depicts a cross-sectional schematic diagram of a portable token; portable or security token 20 includes a transparent planar substrate layer 21, an adhesive that is essentially or substantially transparent to light rays 22, a planar section of naturally-occurring rock of the Earth's crust, of less than 250 micrometers in its least dimension, being in part or in whole transmissive of light rays in its least dimension 23, a transparent planar covering-plate layer 24 or optical window and markings 25, where the substrate layer 21 and covering-plate layer 24 are made of any of the class of materials that are transparent crystalline ceramics or partly-crystalline glass-ceramics, tending to confer strength, abrasion resistance and high optical clarity. The components of the portable or security token 20 are physically joined together by the optically clear adhesive 22, the planar section of rock 23 being within the adhesive component 22. The security token thus described may be, by choice of materials, substantially transparent to wavelengths of light preferably between 250 and 800 nanometers, scratch-resistant, rigid, dimensionally stable and/or durable. In various embodiments, the security token 20 may be made physically strong, or it may be made more frangible to suit an application such as a security-seal element.

In one example, the planar section of naturally-occurring rock may be fashioned from igneous, metamorphic or sedimentary rock and is made to a thickness of thirty micrometers in its least dimension by the known prior art of manufacturing mineralogical 'thin-sections.' The term 'planar rock section' shall also be used to refer to item 23 in the figures. In this same example, the rock shall be preferably selected as being unweathered intact rock that has the preferred properties of any one or more of: a low proportion of opaque minerals; a substantial proportion of optically anisotropic minerals; and variety in mineral types. A metamorphic schist would typify these preferences for a source of rock, though most crustal rocks suffice. With regard to that same example, the thickness of the planar rock section is sufficient to permit the use of a practicable radiant flux from light source 30 and a practicable sensitivity of the image recording device 38, while also preserving certain physical attributes of the planar rock section 23. Variations of section thicknesses may be used, e.g. +/−10 to 15 μm depending on rock properties in this regard.

Figure 2:
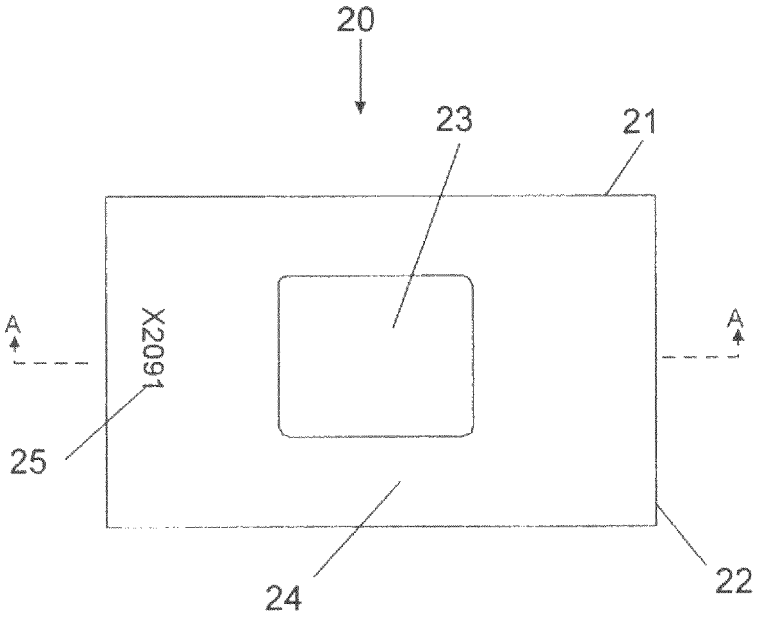
FIG. 2 depicts a plan view of the portable token of FIG. 1.

FIG. 2 depicts a schematic plan view of a portable or security token 20 according to one example, wherein the planar rock section 23 is surrounded by the adhesive 22, to seal it from the external environment. In this particular example, markings 25 may be present on or within the portable token; the markings depicted in FIG. 2 are only an example, the markings may be spatial references, alphanumeric symbols, graphical compositions, or encrypted data. A typical example of markings 25 would be a human-readable reference number for the portable or security token 20. In other examples, the portable token may have: a shape differing from the rectangular embodiment of FIG. 1 and FIG. 2 (e.g. circular, square, triangular, irregular, etc.); perforations; wave-retarding plates included; polarizing filters included; or coloured transparent layers included.

Figure 3:
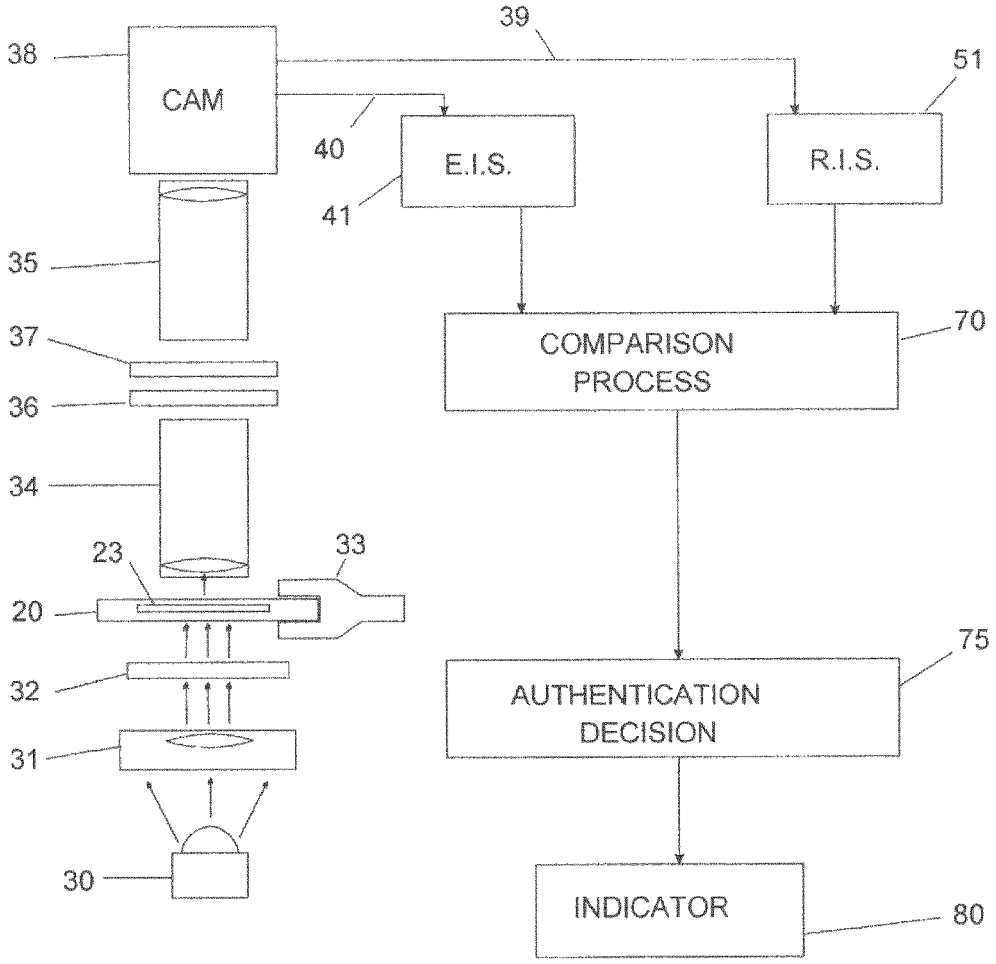
FIG. 3 shows a schematic view of a security token authenticator, given by way of example only.

FIG. 3 shows a schematic view of a security token authenticator, given by way of example only: a system to identify and authenticate a portable token. The figure shows a portable token in an apparatus that performs optical examination of the token by transmitted light and shows paths of data through functional sub-systems. In this figure the data-paths for both reference-images and examination-images are shown; in this embodiment a photographic-plate camera is used.

The form of a system for identifying and authenticating a portable token is depicted schematically in FIG. 3, in which functional components, functional arrangements, functional blocks of the system and data-paths are shown. With reference to FIG. 3: a source of linear-polarized light may be created by the combination of a light source 30, a means of directing light rays, shown as a condenser-lens assembly 31 and a linear-polarizing plate 32. The light source 30 may be monochromatic or polychromatic light, produced by known arts of light-sources (e.g. filament lamps, LEDs, lasers, phosphors, electroluminescent and discharge lamps). The linear-polarizer 32 may also be below or within the condenser-lens assembly 31, and a variable aperture may be present in the condenser-lens assembly 31. Other light sources may be used that do not require the condenser-lens assembly 31. The linear-polarizer 32 may be rotated freely through 360 degrees, about an axis corresponding to the optical axis of the condenser lens, or the path of directed light rays, thus rotating its axis of polarization.

In FIG. 3, a portable token 20 is shown placed upon a supporting-stage 33; the latter may be translated in at least two but preferably three axes, thus enabling translation of the portable token 20 in concert. Linear-polarized light may be directed toward the planar rock section 23 in the portable token 20.

Notwithstanding the presence of any opaque minerals in it, light rays will be transmitted by planar rock section or authentication element 23, in the direction of a means of generating a signal in response to an interaction of light with the authentication element. In this example, the signal is an image. The apparatus of FIG. 3 includes image-forming optics-part A, 34, and image-forming optics-part B, 35, that comprise means of generating an image, by known arts of microscope optics.

The combination of items 34 and 35 provides a magnification ratio of 30, at which a large amount of detail may be apparent in item 23, for practical use. A wave-retarding plate 36 and a linear polarizing plate 37 may be interposed between items 34 and 35: in other implementations the wave-retarding plate 36 may be absent, and in further other implementations the linear polarizing plate 37 may be absent. It is a practical point of configuration that items 36 and 37 may be placed between the objective-lens assembly of item 34 and the ocular assembly of item 35, known in the art of polarizing microscopes: the items 36 and 37 may be positioned, in their depicted sequence, elsewhere in the light-path between the portable or security token 20 (or at least the authentication element) and the camera 38 to the same effect. An image formed by the components 34 and 35, from that light transmitted by portable token 20, may then be recorded by a camera 38. The camera 38 may a photographic plate camera or an electronic detector camera (for example), from which photographic data may be passed through data-paths 39 and 40, as recorded image data. The translation of the portable token 20 in order to obtain different views of it by the camera 38 may be achieved by translating the components 30, 31, 32, 34, 35, 36, 37 and 38 in concert while components 33 and 20 remain stationary, or by other combinations of relative translation.

The following is a descriptive note on the signal or recorded image data obtained using white polychromatic light emitted from item 30 (items 36 and 37 are absent in this example), without limitation as to what is obtained therefrom. The recorded image data or signal may typically show any or all of: irregular dark areas due to opaque minerals; a complex irregular pattern of lines due to mineral-grain boundaries; fractures; internal cleavage-planes; micro-voids; banding; assemblages of mineral-grains; gross crystal forms; and a range of luminances of individual mineral-grains. In this example, various anisotropic mineral-grains may show colour, arising from the different absorption spectra of the ordinary and extraordinary rays in that mineral, in combination; any colour in isotropic mineral-grains would arise from a sole absorption spectrum. The recorded image data or signal may thus be described as maps of luminance or chromaticity, or as a combination of luminance and chromaticity representing colour. If the polarization axis of item 32 is rotated, then the colour and luminance of a particular anisotropic mineral-grain may be seen to change, providing that it is not being viewed in a direction parallel to an optic axis, of which there may be two; this colour-change effect is pleochroism and may be used, qualitatively or quantitatively, to further the identification of the security token 20.

In another example, where the linear polarizing plate 37 is included and its polarization axis is aligned to be orthogonal to that of plate 32, transparent anisotropic mineral-grains may show luminance-variations under their relative rotation to the pair of polarizing plates and variations of colour may be evident; these effects arise from velocity and phase differences between their ordinary and extraordinary rays leading to constructive or destructive interference at different wavelengths when re-combined by polarizing plate 37. Thus, changing attributes for any particular point on a two-dimensional image, or map, may be observed between maps recorded under different relative rotations of the portable token 20 and the polarization axes of polarizing plates 32 and 37: these changes may be used qualitatively or quantitatively in identifying and authenticating the security token 20.

In the example depicted in FIG. 3, the system may use the principle of making a set of reference image data (or previously obtained signals), typically under the control of a trusted entity, and then comparing subsequent image data (or signal generated when authentication is required) from a security token subject to inquiry to that reference image data: substantial sameness may be the basis for identifying and authenticating a security token as being the original item. Referring to FIG. 3, the signal (image data) from camera or optical detector 38 may be passed through data-path 39 when recorded as reference image data; image data from camera 38 may be passed though data-path 40 when recorded as image data to be subject to inquiry. Reference image repository 51 may be a storage of reference image data, which may be retrieved; examination image repository 41 is a storage of image data to be subject to inquiry, which may also be retrieved. A comparison process 70 may retrieve recorded image data from reference image repository 51 and examination image repository 41. The comparison process 70 seeks a substantial sameness between members of the reference image data set and the members of the examination image data set, it may use various means to search, index, align, scale or register images, or any other action required. The comparison process 70 passes data to an authentication decision subsystem 75, which may also pass data back to item 70. The authentication decision subsystem 75 decides whether or not to declare the portable token 20 as authentic based, in the least, upon the data received from the comparison process 70. The authentication decision subsystem 75 may pass data back to the comparison process 70, for example, in the form of requests relating to comparison efforts. Data from the authentication decision subsystem 75 may be passed to an indicator 80; the latter may provide a binary logic indication or output indicative of a declaration by the decision subsystem 75. The indicator 80 may include: switches, binary state-transitions, or any other means of indication.

Figure 4:
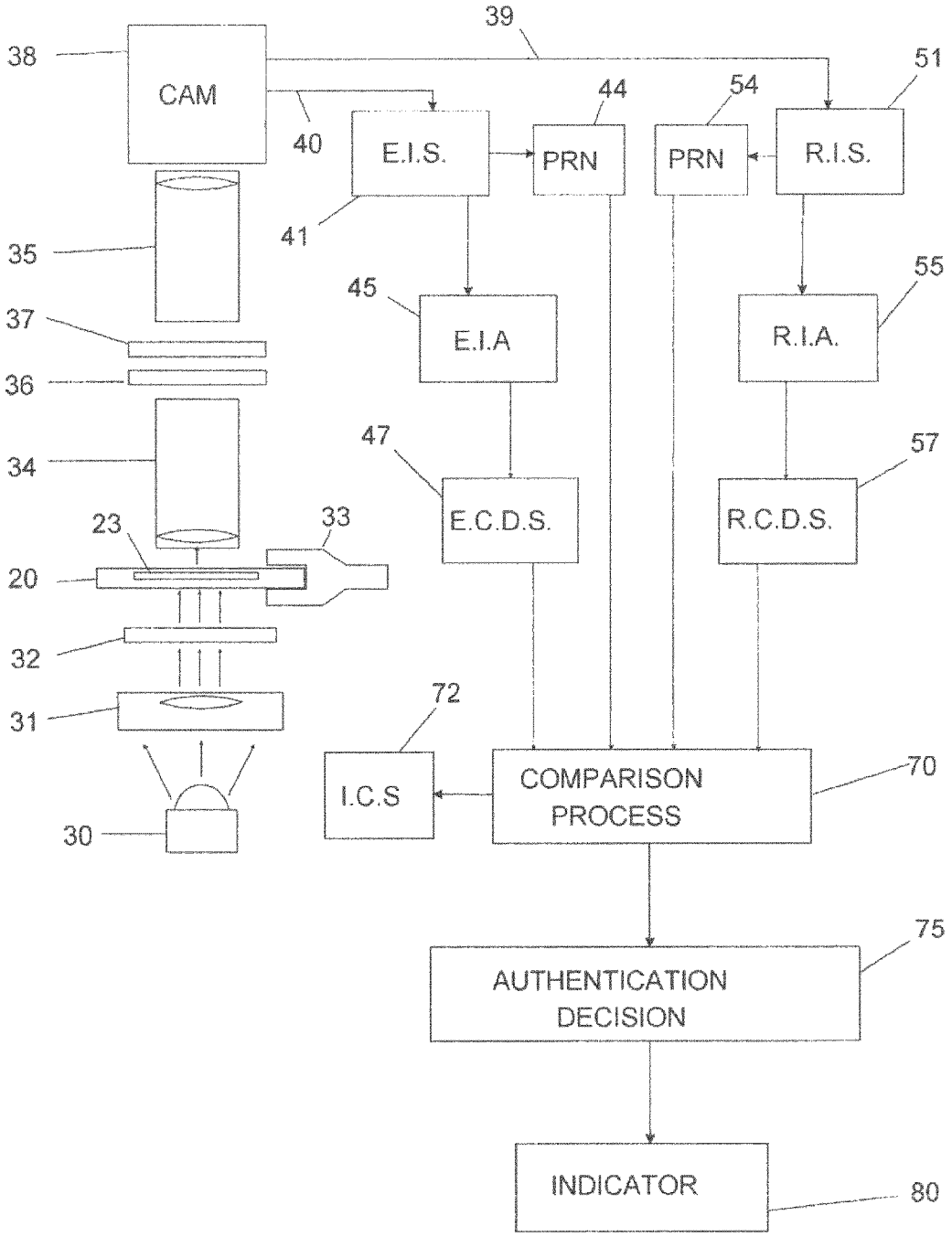
FIG. 4 shows a schematic view of a further security token authenticator.

FIG. 4 depicts an alternative example shown in a schematic form: a system to identify and authenticate the security token 20. Like features are provided with the same reference numerals and will not be described in detail again. The figure shows the security or portable token 20 in an apparatus that performs optical examination of the security token by transmitted light and shows paths of data through functional sub-systems. In this figure the data-paths for both reference-images and examination-images are shown; in this embodiment an electro-optical type of camera is used and sub-systems that perform functions such as image-analysis are shown.

In the example depicted in FIG. 4, image data from an electronic-imaging camera 38 may be passed through data-path 39 when recorded as reference image data (previously obtained signal) and through data-path 40 when recorded as image data to be subject to inquiry (signal generated at time of interrogation). Reference image repository 51 may be a storage of reference image data, which may be retrieved; examination image repository 41 is a storage of image data to be subject to inquiry, which may also be retrieved. A photo-printer 44 may be connected to examination image repository 41 and a photo-printer 54 may be connected to reference image repository 51, both serve to make physical prints from digital image data, if required. An image analysis subsystem 55 may receive two-dimensional image data from the reference image repository 51 and measures and derives attributes and characteristics from a set of images (signals) pertaining to a particular token, it may use a computer processor and memory to do this or to implement the authentication method shown schematically as steps 70, 75 and 80 in FIG. 4 (as well as those described with reference to FIG. 3).

Image analysis subsystem 55 passes data of measurements, attributes and characteristics into reference-characteristics data repository (RCDS) 57. Similarly, an image analysis subsystem 45 receives two-dimensional image data from the examined image repository (EIA) 41 and measures and derives attributes, characteristics and optical properties from a set of images pertaining to a particular token subject to inquiry, it may use a computer processor and memory to do this (not shown in this figure). Image analysis subsystem 45 passes data of measurements, attributes and characteristics into examined-characteristic data repository (ECDS) 47. A comparison process 70 retrieves recorded image data as prints from photo-printer 54, for reference images, and from photo-printer 44, for examination images. A comparison procedure based on electronic data only without physical prints may also or alternatively be carried out. Therefore, the comparison process may be carried out within a computer system on electronic data only. The comparison process 70 seeks a substantial sameness between members of the reference image data set and the members of the examination image data set. Comparison process 70 also retrieves data of measurements, attributes and characteristics from reference-characteristic data repository 57 and examined-characteristic data repository 47, and seeks a substantial sameness between those data pertaining to a particular token.

In the example of FIG. 4, an imaging-control subsystem 72 is shown. Imaging-control subsystem 72 may receive commands from the comparison process 70 and may transmit commands to components 30, 31, 32, 33, 34, 35, 36, 37 and 38, with objects including: varying the brightness of item (light source) 30; varying the polarization-axis of item 32; varying the polarization-axis of item 37; achieving a relative translation of the planar rock section 23, to obtain a different viewing area or focal point at the planar rock section 23; varying the focal points of the image-forming optics 34 and 35. The imaging-control subsystem 72 may, then, be used to direct and control the apparatus that acquires images of the security token 20.

In other examples, data in data-paths or storage or repositories may be encrypted as a security measure; data also may be passed bi-directionally through the data-paths between functional sub-units of the system.

In other examples, the comparison process 70 may use a computer processor, a computer-readable memory and a processor instruction set to carry out its functions.

In other examples, image analysis subsystems 45 and 55 may use a computer processor, a computer-readable memory and a processor instruction set to carry out their functions or to store measured or calculated attributes.

In other examples, a wave-retarding plate 36 may be included which may, for example, improve measurements of colour by presenting a higher 'order' of interference-colours having more saturated chromaticities.

In other examples, certain identifying attributes of one or more mineral grains may be derived to further the verification of identity or provide authentication. Using an illustrative example: the colour exhibited by a particular mineral grain may change with changes in the angular value between the polarization-axis of the linear-polarized light source and a predetermined axis that is orthogonal to the least dimension of the planar rock section; by noting how this colour, or luminance alone, changes with the angle a characteristic can be measured. Such colours may be matched to those in a colour space and to a luminance scale: C.I.E.xyY could be used as an absolute colour space, one in which there are coordinates describing chromaticity and luminance. Coordinates from matching the colour at each angular value can be put into sets, which may define vector-paths in the colour space or luminance scale. Such coordinate sets or vector-paths protect against forgery of an, otherwise, two-dimensional image. When a set of vector-paths is made for a number of suitable mineral grains, they may be correlated. These values may in turn represent optical properties to be compared.

One or more features from any embodiment may be combined with one or more features of any other embodiment without departing from the scope of the disclosure. In this specification a recitation of 'a', 'an' or 'the' is intended to mean 'one or more', unless specifically otherwise indicated.

As will be appreciated by the skilled person, details of the above embodiment may be varied without departing from the scope of the present invention, as defined by the appended claims.

For example, the material of the authentication element may also be crystalline ceramic or polycrystalline material.

The expression 'grain' is an accepted one in the subfields of materialography, such as ceramography, metallography and petrography; a grain, in that context, may in some cases contain multiple crystals or crystallites. Therefore, other types of material grain may be used.

Other example materials for use as the authentication element include fused or sintered materials having anisotropic crystals, and also crystallite assemblages derived from cooled-melts or deposition methods. For example, fused-alumina ceramic, may be used. Partly-crystalline ceramics including some amorphous glass as well as crystals may also be used.

Examples of the polycrystalline materials that may be used include chemical or vapour depositions of tin oxides, most usually as thin films; molten ceramics will generally result in polycrystalline textures when they solidify, also. Crystallite assemblages of (transparent or generally transparent) tin oxides, and their like, are frequently made via chemical or vapour deposition and are usually referred to as thin-films rather than ceramics, as they have not been made by a hot firing process. Thicker wafers of such materials may be used as the authentication element especially if they contain anisotropic crystallites.

Not all 'crystalline ceramics' will be anisotropic. The ceramic non-oxide carbides, nitrides and borides are generally only transparent to infrared, whereas the oxides such as alumina, beryllia, yttria, ceria and zirconia are generally visible-transparent. The last two of those can be forced from their usual cubic habit into anisotropic crystal systems via cooling regimes or doping techniques, for example. Natural rock has advantages in terms of resistance to duplication attempts due to heterogeneous minerals, intergrowth, zonation and profound detail.

Composite material such as concrete may be used. In this example the planar material section may be a multiplicity or one or more rock elements.

Further example implementations of the linear polariser include a second linear polarizer.

Crossed-polarisers may be used and arranged substantially 90 degrees +/−1 to 3 degrees, or other angles may be used.

A confidence value approach may be used when determining authentication. The described system and method may lead to an authentication decision or a binary indication output but may instead use the output of the comparison process to give a non-binary value of confidence of authenticity.

Polarisers provide variability under rotation, which improves the distinguishing nature of the security token but may be absent for some embodiments.

A three axis, xyz, translator component may provide panning and dollying movement to the optical detector components of the security token authenticator.

Current CCD and CMOS densities and film-grain may allow 4× magnification to be used with a single lens.

However, a pinhole aperture may also be used. Optics could be diffractive-type also, e.g. holograms and Fresnel lenses. In practice a 'plan' objective may be used, preferably achromatically constructed if using other than monochromatic light. Strain-free optics are preferable in most of polarised microscopy.

For illumination the microscope may use powerful filament lights and the Kohler illumination method to de-focus a point source to give an even field of illumination. Such illumination may use an Abbe condenser. However, an extended light source such as an electroluminescent or phosphorescent/fluorescent panel may be used, with low magnification. Coherent laser light may often be strongly polarised and, in such a case, could be used without the polarisers.

Various signals and images may be observed from transillumination of the secure token by using a polarising microscope such as an Olympus CX31-P, or a similar petrographic or materialographic instrument from such manufacturers as Zeiss, Nikon or Leica-Microsystems: these instruments usually rotate the stage upon which the subject is held. In practice some compensation may be required for the thickness of any uppermost layer or window of the secure token. Digital electronic storage of the signals and images may be preferable to storage of photographic plates or prints or other means of storage of data.

A preferred material for the top and/or bottom layers of the security token is single-crystal sapphire (alumina) that has been sliced normal to its c-axis (so-called 'c-plan sapphire'): this type of section all but eliminates effects from the (hexagonal, uniaxial) birefringent anisotropic sapphire. Manufacturers include Tydex, Monocrystal, Saint-Gobain, Rubicon and Kyocera. Other possible materials for these optical layers include transparent synthetic spinel—a Magnesium-Aluminium-Oxide variant of the spinel family and aluminium-oxy-nitrides like ALON™. Both are usually sub-micron crystalline and effectively isotropic as a result. An example thickness for the layer, or window may be 1 mm to 2 mm. However, this thickness may be halved for less durable uses. Glass-ceramics, like Zerodur™, may also be used.

Adhesive cement may be used to bond the materials within the security token. An optical cement, such as UV-curing acrylate or an epoxy type, such as Norland NOA-61 may be used, for example.

Examples of images similar to those that may be observed from transillumination of the secure token by using a polarising microscope may be found in publicly available books on petrography or mineralogy or on the world-wide-web internet.

Fine-focus adjustment as well as passive auto-focusing by contrast-detection may be used within the microscope. Trial and error focus adjustment may be used to determine a sharp-focus configuration.

An automated three axis, xyz, translator stage may be used to move the security token. These include piezoelectric micro-steppers, for example. The employment of a variety of mechanical, electric or thermal drives may be controlled by the ICS item.

According to one implementation, both polarisers may be arranged having a fixed-axis. Removing and replacing one of those polarisers may then provide two different images of, or signals from, the same secure token: by example only, an image showing colours associated with pleochroism and another image showing colours associated with lightwave interference. Such an implementation would in practice require adequate enclosure to exclude dust and contaminants.

Multi-angle image-sets may be acquired using further motorisation techniques. Rotation through 90 degrees plus a small margin may occur to ensure luminance-changes or colour-changes fully cycle over this angle. Preferably, each polariser may have independent drive capability, although usually coupled, so that the maximum and minimum signal intensities may be ascertained, in the absence of any secure token. The camera shutter (physical or electronic), or frame-separation method, may be synchronised with the angle stepping.

Many combinations, modifications, or alterations to the features of the above embodiments will be readily apparent to the skilled person and are intended to form part of the invention. Any of the features described specifically relating to one embodiment or example may be used in any other embodiment by making the appropriate changes.

The above description is provided to illustrate the main principles of the invention, by examples of various embodiments, and is not to be construed as restrictive. Variations or other embodiments within the scope of the disclosure of the invention may be apparent to those skilled in the art upon review of the foregoing disclosure. Thus, the scope of the disclosure of the invention shall be defined only by the full scope of the claims set forth below.

The invention claimed is:

1. A security token authenticator comprising:

an optical detector comprising a camera, and configured to receive light transmitted through an authentication element within a security token, the optical detector arranged to generate an image in response to an interaction of the light with the authentication element within the security token, the authentication element formed from a solid anisotropic crystalline ceramic material;

one or more linear polarisers arranged to vary a polarisation of the light interacting with the authentication element and/or the light received by the optical detector; and a processor configured to:

compare the generated image with a previously obtained signal from the authentication element; and provide an output based on the comparison.

2. The security token authenticator of claim 1, wherein comparing the generated signal with a previously obtained signal comprises:

determining an optical property of the authentication element from the generated signal;

comparing the determined optical property to the same type of optical property derived from the previously obtained signal of the authentication element.

3. The security token authenticator according to claim 2, wherein the determined optical properties are selected from the group consisting of: polarisation; image structure; refractive index; colour; chromaticity; luminance variations; optical absorption; and opacity.

4. The security token authenticator according to claim 1, further comprising a mechanical alignment mechanism arranged to align the authentication element with the optical detector.

* * * * *